US007796764B2

(12) United States Patent
Lucioni

(10) Patent No.: US 7,796,764 B2
(45) Date of Patent: Sep. 14, 2010

(54) METHOD AND DEVICE FOR REPRODUCING A BINAURAL OUTPUT SIGNAL GENERATED FROM A MONAURAL INPUT SIGNAL

(75) Inventor: Gonzalo Lucioni, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 1114 days.

(21) Appl. No.: 10/945,789

(22) Filed: Sep. 21, 2004

(65) Prior Publication Data

US 2005/0069140 A1 Mar. 31, 2005

(30) Foreign Application Priority Data

Sep. 29, 2003 (DE) ..... 103 45 167

(51) Int. Cl.
*H04R 5/00* (2006.01)

(52) U.S. Cl. ..... 381/17; 381/1; 381/310

(58) Field of Classification Search ..... 381/1–23, 381/77, 110, 58–59, 96, 98, 102, 104–109, 381/309–311, 61, 63
See application file for complete search history.

(56) References Cited

U.S. PATENT DOCUMENTS 4,359,608 A * 11/1982 Watson et al. ..... 704/205
4,864,608 A * 9/1989 Miyamoto et al. ..... 379/406.07
5,056,149 A * 10/1991 Broadie ..... 381/17
5,173,944 A * 12/1992 Begault ..... 381/17
5,235,646 A 8/1993 Wilde et al.
5,485,514 A 1/1996 Knappe et al.
6,408,327 B1 * 6/2002 McClennon et al. ..... 709/204
6,850,496 B1 * 2/2005 Knappe et al. ..... 370/260
6,973,184 B1 * 12/2005 Shaffer et al. ..... 379/420.01
7,006,636 B2 * 2/2006 Baumgarte et al. ..... 381/17
7,209,566 B2 * 4/2007 Griniasty ..... 381/59
2003/0035553 A1 2/2003 Baumgarte et al.
2004/0228476 A1 * 11/2004 Denninghoff ..... 379/428.02

FOREIGN PATENT DOCUMENTS

DE 3737873 A1 5/1989
EP 1168734 A1 1/2002
WO 0225999 A2 3/2002
WO 02069670 A1 9/2002

OTHER PUBLICATIONS

Blauert, Jens, "Spatial Hearing", MIT Press, Jun. 1997, Ch. 5.3 and 5.4. (Book).

* cited by examiner

*Primary Examiner*—Vivian Chin
*Assistant Examiner*—Fatimat O Olaniran

(57) ABSTRACT

The invention relates to a method and a device for reproducing a binaural output signal generated from a monaural input signal and comprising a first output signal and a second output signal via at least a first and a second speaker of a binaural headset particularly for VoIP applications.

19 Claims, 2 Drawing Sheets

METHOD AND DEVICE FOR REPRODUCING A BINAURAL OUTPUT SIGNAL GENERATED FROM A MONAURAL INPUT SIGNAL

CROSS REFERENCE TO RELATED APPLICATIONS

This application claims priority to the German application No. 10345167.6, filed Sep. 29, 2003 and which is incorporated by reference herein in its entirety.

FIELD OF INVENTION

The invention relates to a method for reproducing a binaural output signal generated from a monaural input signal and comprising a first output signal and a second output signal and a device adapted for implementing the method.

BACKGROUND OF INVENTION

Intelligent data terminals, e.g. PCs and PDAs, are increasingly used for voice communication in modern communication systems, with said data terminals being linked by means of VoIP for example.

Packet-based communication using VoIP and the associated deployment of what are known as VoIP Codecs has undesirable effects on voice quality. For example average to fairly long transit times can be expected during signal transmission, resulting in audible echoes. Also with packet-based communication, it is necessary to take into account reflections, the transit times of which are often longer and the attenuation of which is lower than that found in a natural environment. Therefore measures have to be implemented to suppress disruptive echoes, preferably by using echo cancellers in the data terminals.

Echo cancellers are based on current standards, e.g. ITU-T G.168 (2002), where for example gateway interfaces to the conventional telephone network are discussed. Alternatively ITU-T G.165 (1993) can be used for VoIP terminals, whereby this specifies significantly less stringent parameters relating to echo dispersion and required suppression than is the case with conventional telephony standards.

If the data terminals themselves are configured as VoIP terminals, they have the disadvantages of longer transit times during signal transmission and lack of echo cancellers compared with dedicated VoIP terminals. The lack of canceller in particular means that headsets have to be used for packet-based communication of this nature.

However conventional binaural headphones result in a rather un-natural hearing event, as the sound is no longer influenced by the head and the outer ear. In the case of natural hearing both ears receive the signals from all sound sources, so that time delays, level differences and tone differences create a spatial hearing experience. Tests on directional perception of incoming sound show that interaural transit time and level differences are only relevant in relation to a horizontal plane of symmetry of the head, so the direction of the incoming sound can be determined here. No time delays or level differences occur in respect of a vertical plane of symmetry of the head but the direction of the incoming sound is perceived here by means of tone differences. Three-dimensional hearing is important for spatial orientation, the differentiation of different sound sources (see Blauert, Jens (June 1997): Spatial Hearing, MIT Press, ch. 5.3) and the suppression of reflection perception (ibid, ch. 5.4). As the sound sources are located directly at the ears when headphones are used, three-dimensional hearing is prevented. The right ear only receives the signals from the right speaker, while the left ear only receives the signals from the left speaker.

SUMMARY OF INVENTION

The object of the invention is therefore to develop a method and a device for reproducing an output signal generated from a monaural input signal so that the quality of monaural VoIP voice connections using headsets is improved.

This object is achieved by the claims.

According to the invention the object is achieved by a method, with which a binaural output signal generated from a monaural input signal and comprising a first output signal and a second output signal is reproduced via at least a first and a second speaker of a binaural headset, particularly for VoIP applications. The first output signal and/or the second output signal is hereby generated for binaural simulation from the monaural input signal by phase displacement and/or amplitude amplification, to obtain a hearing event that represents a subjectively experienced static or dynamic positioning of a sound event.

The object is also achieved by a device, with which a binaural headset, particularly for VoIP applications, has at least a first and a second speaker to output a binaural output signal generated from a monaural input signal and comprising a first output signal and a second output signal and a connection to a receiver-side data terminal. A signal processing device generates the first output signal and/or the second output signal for binaural simulation from the monaural input signal by phase displacement and/or amplitude amplification, to obtain a hearing event that represents a subjectively experienced static or dynamic positioning of a sound event.

One important aspect of the invention is that the binaural simulation means that spatial hearing, largely experienced as natural, is achieved despite the use of headphones.

The natural path of the sound, namely free-field, outer ear and auditory canal transmission or natural hearing achieved through phase differences, time delays, level differences and tone differences, is thereby simulated using phase, transit time, attenuation and/or HRTF (Head Related Transfer Function) processing elements. Such simulation allows the perception of reflections, for example tone loss or echoes, to be suppressed to the maximum, as the occurrence of echoes is to a certain degree controlled mentally and is a function for example of experience and awareness. This is due particularly to the fact that sound events occurring at the same time but originating from different sound sources can be more easily differentiated. This improves the ability of the hearer to concentrate on one sound source and pinpoint its sound events perceptively in relation to the sound events of the other sources. Moreover the simulation of three-dimensional hearing means that the precedence effect, i.e. the law of the first wave front, can be used, once the sound from a plurality of coherent sources reaches the listener from different directions. The sound event then seems to come only from one direction, whereby echoes are not perceived.

In a first preferred embodiment therefore the monaural input signal is supplied to the VoIP application by a transmitter-side and/or receiver-side data terminal. This has the advantage particularly that the sound event generated by the receiver-side terminal is included in the binaural simulation as well as the sound event generated by the transmitter-side data terminal. With natural hearing a person's own voice can also be heard as a three-dimensional sound event, so a clear delimitation is possible in respect of a further sound source, e.g. a further speaker.

The static positioning of the sound event caused by the transmitter-side data terminal is advantageously simulated by phase displacement in a first sub-function. For this the first output signal is generated by a delay to the input signal supplied by the transmitter-side data terminal or the sign is reversed and said signal is fed to the first speaker. The second output signal is also generated by unmodified reproduction of the input signal and this is fed to the second speaker. The static positioning of the sound event caused by the transmitter-side data terminal is hereby preferably achieved "closer" to the second speaker. A first component for generating a three-dimensional hearing event is implemented here based on phase displacement and the associated different transit times of the two output signals.

In one advantageous embodiment the dynamic positioning of the sound event caused by the transmitter-side data terminal is simulated in a second sub-function. For this a mean level comparison is effected between the input signal supplied by the transmitter-side data terminal and the monaural input signal supplied by the receiver-side data terminal. The input signal supplied by the transmitter-side data terminal is then delayed, to generate the first output signal via this first delay. A second delay to the input signal provides the second output signal. The first output signal reaches the first speaker, the second output signal is fed to the second speaker. This means that the dynamic positioning of the sound event caused by the transmitter-side data terminal is achieved "closer" to the respective speaker, which the corresponding output signal reaches first due to a different transit time. With regard to the dynamic positioning of sound events, a further component for generating a three-dimensional hearing event is advantageously implemented based on phase displacement and the associated different transit times of the two output signals.

Static and dynamic positioning here describe simulation of the directional perception of the incoming sound from the point of view of the receiver-side data terminal or the receiver-side user. In other words the arrival of the generated sound event from a specific direction is simulated. If static positioning is simulated, the sound supplied is processed such that the hearing event generated by it gives rise to the assumption that the transmitter-side user is not moving. Simulation of a moving transmitter-side user on the other hand is described by the dynamic positioning of said user. The sound is processed such that a change of location by the transmitter-side user is simulated. Simulation of both the static and dynamic positioning of the sound event therefore allow a hearing experience experienced as natural hearing in the event of audio transmission.

Static positioning of the sound event caused by the receiver-side data terminal is preferably simulated in a third sub-function. For this a delay is effected to the monaural input signal supplied by the receiver-side data terminal to reproduce this as the first output signal. At the same time the input signal is reproduced unmodified to supply it as the second output signal. The first output signal then reaches the second speaker while the second output signal is fed to the first speaker. Static positioning is therefore achieved in that the sound event caused by the receiver-side data terminal appears "closer" to the first speaker.

Inherent reflections with short delay, as proposed here, are desirable and are described in detail in conventional telephony. See also for example ITU-T G.131 (1996) or ITU-T G.111 (1993) Annex A, keyword STMR (Side Tone Masking Rating, Talkers's Sidetone).

Static positioning of the sound event caused by the transmitter-side data terminal and static positioning of the sound event caused by the receiver-side terminal are advantageously simulated at the same time. This essentially corresponds to a combination of the first and third sub-functions. The incoming sound at both terminals involved in the voice transmission can therefore be perceived from different directions, including the echo of the receiver-side terminal. The precedence effect of the sound generated by the receiver-side data terminal is amplified at the same time. What is known as the echo threshold according to Blauert is shown in FIG. 1 based on this. See also FIG. 3.13 of ITU-T G.131 for typical amplification in the terminal. The TELR (Talker Echo Loudness Rating) "gain" can be clearly identified.

In a different embodiment the inventive solution provides for simultaneous simulation of the dynamic positioning of the sound event caused by the transmitter-side data terminal and static positioning of the sound event caused by the receiver-side data terminal. This essentially corresponds to a combination of the second and third sub-functions. The sound event caused by the receiver-side data terminal, the echo of this sound event and the sound event caused by the transmitter-side data terminal are thereby advantageously perceived from different directions. This makes it possible to pinpoint the incoming sound from the transmitter-side data terminal or the incoming sound from the receiver-side data terminal perceptively in relation to the echo of the incoming sound from the receiver-side data terminal.

In a further preferred embodiment the binaural headset is configured with a signal processing device, which has at least one transit time element. The transit time element thereby generates the above-mentioned phase displacement of the respective output signals. Alternatively or additionally the signal processing device can provide at least one attenuation element and/or at least one HRTF (Head Related Transfer Function) processing element. Amplitude amplification and/or tone differences can then also be generated as well as phase displacements. With these elements, with the combination of elements and particularly with the combination of all the elements realistic three-dimensional hearing can advantageously be generated even when using binaural headphones, as natural hearing is characterized by time delays, intensity differences and tone loss.

Further features and advantages of an inventive device will emerge from the features and advantages of the inventive method.

The invention is described in more detail below with reference to an exemplary embodiment that is described with reference to the drawing, in which:

DETAILED DESCRIPTION OF INVENTION

Figure 1:
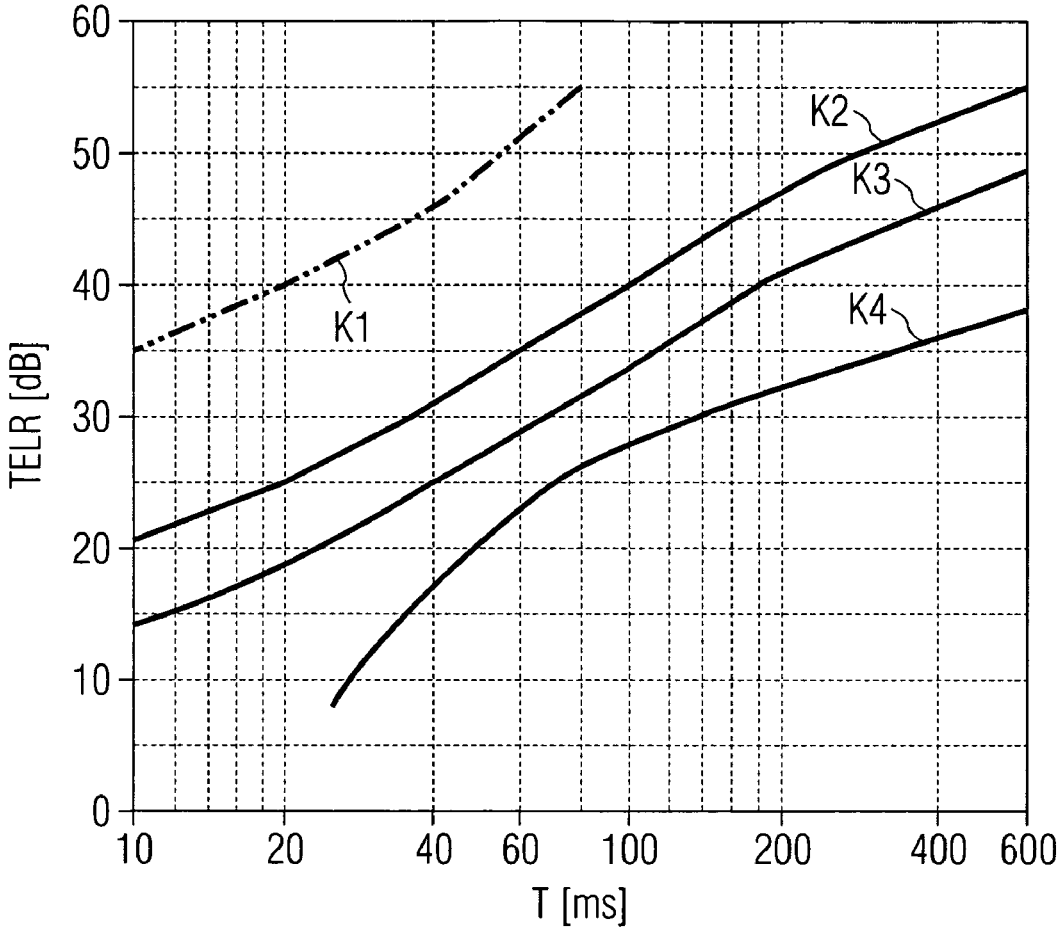
FIG. 1 shows talker echo tolerance curves.

FIG. 1 shows what are known as talker echo tolerance curves, which allow conclusions to be drawn about voice quality from the echoes occurring. The curves thereby allow the acceptability of the conversation to be judged. The abscissa shows the mean echo transmission time T and the ordinate the talker echo loudness rating TELR. The curve K1 shows the masked threshold, the curve K2 shows the acceptable. The acceptable is equivalent to the curve, in which a disruptive echo occurs with a probability of 1%. The curve K3 shows the limiting case, the curve K4 the binaural limiting case for an arrangement of stereophonic speakers at an angle of 80°).

Figure 2:
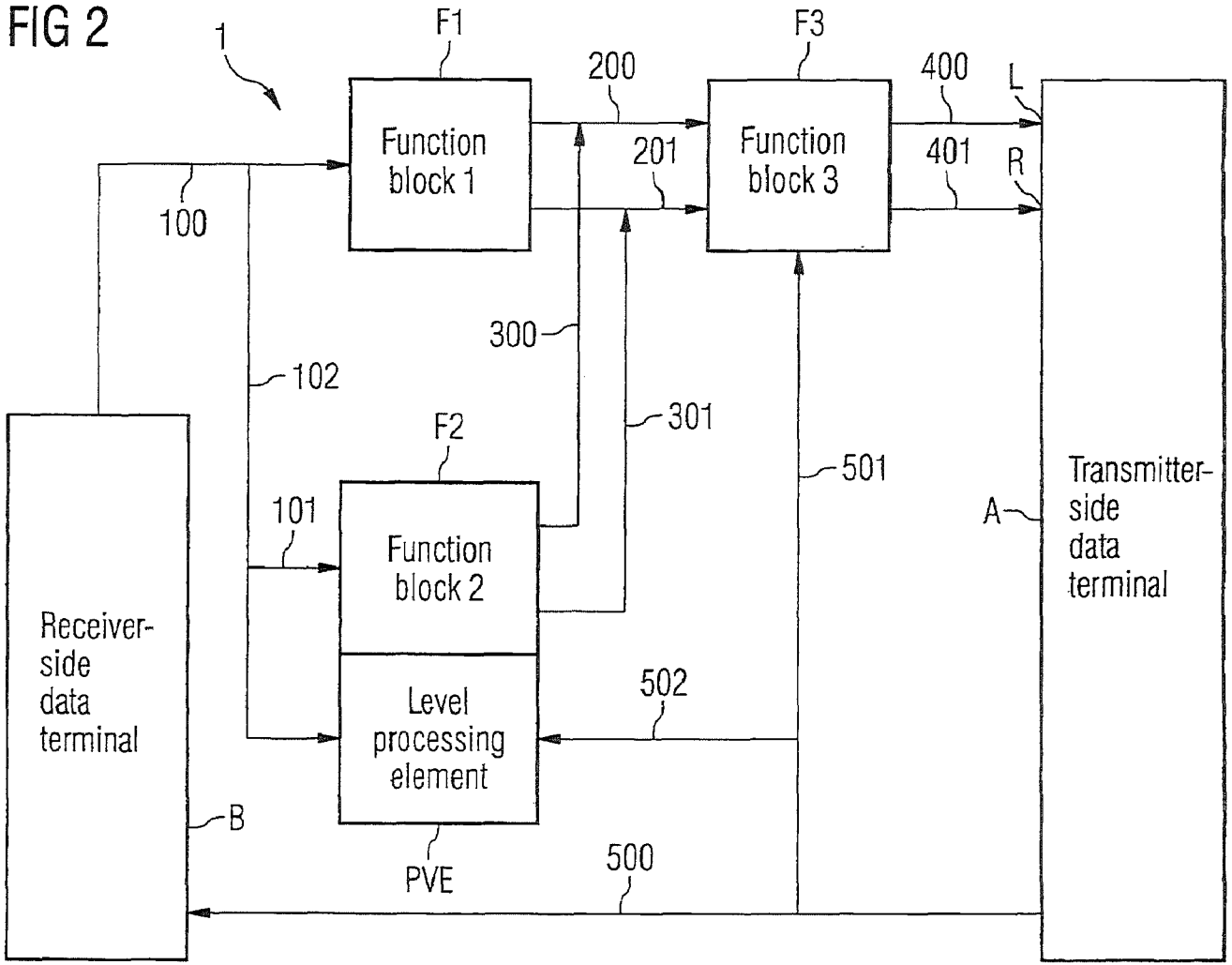
FIG. 2 shows an embodiment of the invention.

FIG. 2 shows an exemplary embodiment of the inventive device as a functional block circuit diagram. Here a transmitter-side data terminal is shown with the reference character A and a receiver-side data terminal with the reference character B. The transmitter side data terminal B is ideally equipped with binaural headphones, which in turn have a first speaker L and a second speaker R.

To control the signal flow accordingly, there is a signal processing device 1 between the respective terminals A, B. In this embodiment the signal processing device 1 has three function blocks F1, F2, F3 and a level processing element PVE.

The function blocks F1, F2 and F3 each have at least one transit time element (not shown). Alternatively or additionally the function blocks F1, F2 and F3 can also each be configured with at least one attenuation element and/or an HRTF (Head Related Transfer Function) processing element (not shown).

In this exemplary embodiment the function block F1 and the function block F2 are connected in series, while the function block F2 is connected parallel to the function block F1.

A voice connection is set up from the receiver-side data terminal B to a transmitter-side data terminal A, whereby the link operates by means of a switching network using VoIP.

The receiver-side data terminal B transmits a monaural input signal in a step 100 to the first function block F1. At the same time the receiver-side data terminal B transmits the monaural input signal in a step 101 to the function block F2 and in a step 102 to the level comparison element PVE.

The function block F1 delays the received signal and transmits it in a step 200 to the function block F3. At the same time the function block F1 allows the received signal to pass unmodified and transmits the unmodified signal similarly in a step 201 to the function block F3. The signal present at the function block F2 from step 101 is subject to a first delay in the function block F2 and is transmitted with this in a step 300 to the function block F3. At the same time the signal present at the function block F2 from step 101 is subject to a second delay and is transmitted with this in a step 301 to the function block F3.

In a step 102 the level comparison element PVE also receives the signal supplied by the receiver-side data terminal B. At the same time a signal supplied by the transmitter-side data terminal A is present at the level comparison element PVE and this is forwarded in a step 502. The first and second delays to the signal supplied by the receiver-side data terminal B implemented in the function block F2 and described above are then effected as a function of a mean level comparison of the signals supplied by the data terminals A, B.

The signals originating from steps 200 and 300 or from steps 201 and 301 are now present at the function block F3. At the same time the signal from the transmitter-side data terminal originating from a step 501 is present at the function block F3. In this exemplary embodiment the signals originating from steps 200 and 300 can pass function block F3 without hindrance and are then fed in a step 400 to the first speaker L. The signals resulting from steps 201 and 301 and present at the function block F3 can also pass the last function block F3 without further processing but are fed in a step 401 to the second speaker R. The signal delays already implemented beforehand in the function blocks F1 and F2 mean that on the one hand static positioning of a sound event induced by the transmitter-side data terminal A takes place "closer" to the second speaker R, while on the other hand dynamic positioning of a sound event induced by the transmitter-side data terminal A is achieved "closer" to the respective speaker, which receives the signals with the shorter delays in each instance.

The function block F3 delays the signal transmitted in step 501 and feeds this to the second speaker R. At the same time the signal transmitted in step 501 passes the function block F3 without hindrance and is transmitted to the first speaker L. As a result, as mentioned above, static positioning of the sound event induced by the transmitter-side data terminal A is achieved "closer" to the first speaker L.

Finally in a step 500 the transmitter-side data terminal A sends a signal without further processing directly to the receiver-side data terminal B.

The splitting of a monaural input signal proposed here and its processing to achieve transit time differences allows three-dimensional hearing via binaural headphones, which is experienced as natural hearing. As natural hearing results from transit time differences, level differences and tone loss in the incoming sound from different sound sources, hearing experienced as three-dimensional can ideally be experienced by generating transit time differences along with level differences and tone loss.

The exemplary embodiment described above describes the function blocks as signal processing blocks, the purpose of which is to generate transit time differences and therefore phase differences from a monaural input signal by splitting it. Alternatively it is possible to replace the transit time elements with attenuation elements. A spatial hearing experience is thereby experienced, which is only achieved by means of amplitude amplification or attenuation. It is also possible to provide only HRTF (Head Related Transfer Function) processing elements, to simulate the nature of the head and ears and thereby the directional characteristics of the ear. The function blocks F1 to F3 can however hold all the signal processing elements at the same time, to achieve an optimum result in respect of simulation of natural hearing.

Alternatively (not shown) it is for example possible to combine the function blocks F1 and F3. This essentially corresponds to the embodiment shown in FIG. 2, without however making the monaural input signal supplied by the receiver-side data terminal B available at the function block F2. The signals then pass through the function block F3 at the same time as the input signal supplied by the transmitter-side data terminal A is being processed to be fed to the speaker L or R.

It is also possible (also not shown) for the function blocks F2 and F3 to be combined. FIG. 2, as already described, can be used as a basis here too but without function block F1. The monaural input signal supplied by the receiver-side data terminal B is supplied here exclusively to the function block F2 or to the level comparison element PVE, to forward the resulting output signals via the function block F3 to the speakers L and R. According to the sub-function F3 processing of the monaural input signal from the receiver-side data terminal B takes place in the function block F3.

The combination of two function blocks represents a high-quality but nevertheless low-cost variant, whereby the quality of the three-dimensional simulation can be tailored in each instance to the area of use of the headset.

Changing the monaural signal using one of these processing elements also generates a hearing event, which reflects at least components of natural hearing. It is therefore possible using the proposed headset to locate different sound sources and particularly to suppress the perception of reflections. This is substantiated by the natural hearing experience, with which people have actually learned to suppress reflection perception.

The exclusive use of individual function blocks as transit time elements and/or attenuation elements and/or HRTF processing elements allows a spatial hearing experience, which is for example adequate, if little background noise occurs during communication.

It should be pointed out here that all the above elements described, taken alone and in any combination, particularly the detailed representations in the drawing, are claimed as essential to the invention. The person specialized in the art is accustomed to making modifications. Therefore means for reversing the sign of one of the processed signals can replace the transit time elements or delay elements mentioned above.

The invention claimed is:

1. A method for reproducing a binaural output signal generated from a monaural input signal comprising:

providing a first function block;

providing a second function block;

providing a third function block;

providing a level processing element;

configuring the first function block to receive at least one signal from a receiver side data terminal;

configuring the second function block to receive at least one signal from the receiver side data terminal;

delaying at least one signal received from the receiver side data terminal with the first function block and transmitting that delayed at least one signal in a first transmission to the third function block and transmitting the at least one signal in a second transmission to the third function block without adding a delay to that at least one signal of the second transmission;

delaying the at least one signal received from the receiver side data terminal with the second function block and transmitting that delayed at least one signal in a third transmission to the third function block and delaying the at least one signal received from the receiver side data terminal with the second function block and transmitting that delayed at least one signal in a fourth transmission to the third function block;

transmitting a first speaker signal from the third function block toward a first speaker, the first speaker signal comprised of the first transmission and the third transmission; and transmitting a second speaker signal from the third function block toward a second speaker, the second speaker signal comprised of the second transmission and the fourth transmission; and processing at least one signal received from the receiver side data terminal and at least one signal received from a transmitter side data terminal with the level processing element to affect the delay of the at least one signal received from the receiver side data terminal provided by the second function block in the third transmission and to affect the delay provided by the second function block in the fourth transmission.

2. The method of claim 1 wherein the transmission of the first speaker signal occurs without the third function block adding any additional delay of the first transmission and third transmission and wherein the transmission of the second speaker signal occurs without the third function block adding any additional delay to the second transmission and the fourth transmission.

3. The method of claim 1 wherein the level processing element is integral with the second function block and wherein the delay added to the at least one signal in the third transmission by the second function block is different than the delay added to the at least one signal in the fourth transmission by the second function block.

4. The method of claim 1 wherein the level processing element processes the at least one signal received from the receiver side data terminal and at least one signal received from the transmitter side data terminal such that the delays provided in the third transmission and fourth transmission by the second function block are affected by a mean level comparison of signals provided by the receiver side data terminal and the transmitter side data terminal.

5. The method of claim 1 further comprising delaying at least one signal received from a transmitter side data terminal with the third function block and wherein the second speaker signal is also comprised of the delayed at least one signal received from the transmitter side data terminal.

6. The method of claim 5 wherein the first speaker signal is comprised of at least one signal received from the transmitter side data terminal and wherein the third function block does not add any delay to the at least one signal received from the transmitter side data terminal portion of the first speaker signal.

7. The method of claim 1 wherein the transmittal side data terminal is comprised of a headset having binaural headphones, the headphones having the first speaker and the second speaker; and an additional signal is sent directly from the transmitter side data terminal to the receiver side data terminal.

8. The method of claim 1 further comprising configuring the third function block to be in series with the first function block.

9. The method of claim 1 wherein at least one of the first function block, second function block and third function block is comprised of at least one element selected from the group consisting of transit time elements, attenuation elements, and head related transfer function processing elements.

10. The method of claim 1 wherein the at least one signal received from the receiver side data terminal is at least one monaural input signal.

11. A method of claim 1 wherein the first speaker signal and second speaker signal are binaural signals.

12. The method of claim 1 wherein the first function block is combined with the third function block such that the first function block and third function block form a unitary function block.

13. The method of claim 12 wherein signals pass through the third function block at the same time the at least one signal received from the receiver side data terminal is being processed.

14. A device for producing or reproducing a multi-aural output signal generated from a monaural input signal comprising:

a first function block configured to receive at least one signal from a receiver side data terminal;

a second function block configured to receive at least one signal from a receiver side data terminal;

a third function block operatively connected to the first function block and the second function block;

the first function block configured to add a delay to the at least one signal received from the receiver side data terminal and transmit that delayed at least one signal in a first transmission to the third function block and also transmit the at least one signal in a second transmission to the third function block without the added delay;

the second function block configured to add a delay to the at least one signal received from the receiver side data terminal and transmit that delayed at least one signal in a third transmission to the third function block and also add a delay to the at least one signal received from the receiver side data terminal and transmit that delayed at least one signal in a fourth transmission to the third function block;

the third function block configured to transmit a first speaker signal comprised of the first transmission and the third transmission toward a first speaker; and the third function block configured to transmit a second speaker signal comprised of the second transmission and the fourth transmission toward a second speaker; and a level processing element connected to the second function block, the level processing element configured to affect delays provided by the second function block as a function of at least one signal received from a transmitter side data terminal.

15. The device of claim 14 wherein the delay added to the at least one signal of the fourth transmission is different than the delay added to the at least one signal of the third transmission.

16. The device of claim 14 wherein the level processing element is configured to process at least one signal received from the receiver side data terminal and at least one signal received from the transmitter side data terminal such that delays provided in the third transmission and fourth transmission by the second function block are affected by a mean level comparison of signals provided by the receiver side data terminal and the transmitter side data terminal.

17. The device of claim 14 wherein at least one of the first function block, second function block and third function block is comprised of at least one element selected from the group consisting of transit time elements, attenuation elements, and head related transfer function processing elements.

18. The device of claim 14 wherein the first function block and the third function block are arranged in series.

19. A device for producing or reproducing a multi-aural output signal generated from a monaural input signal comprising:

a first function block configured to receive at least one signal from a receiver side data terminal;

a second function block;

the first function block configured to add a first delay to the at least one signal received from the receiver side data terminal and transmit that first delayed at least one signal in a first transmission to the second function block and also add a second delay to the at least one signal received from the receiver side data terminal and transmit the second delayed at least one signal in a second transmission to the second function block, the first delay being different than the second delay;

the second function block configured to transmit a first speaker signal comprised of the first transmission toward a first speaker; and the second function block configured to transmit a second speaker signal comprised of the second transmission toward a second speaker; and wherein the first function block is comprised of a level comparison element and is configured to receive a signal from a transmitter side data terminal to affect the first and second delays.

* * * * *